US008936536B2

(12) United States Patent
Detterberg

(10) Patent No.: US 8,936,536 B2
(45) Date of Patent: Jan. 20, 2015

(54) EXERCISE APPARATUS

(75) Inventor: Henrik Detterberg, Albertslund (DK)

(73) Assignee: Detterberg Group ApS, København N (DK)

( * ) Notice: Subject to any disclaimer, the term of this patent is extended or adjusted under 35 U.S.C. 154(b) by 525 days.

(21) Appl. No.: 13/138,940

(22) PCT Filed: Apr. 29, 2010

(86) PCT No.: PCT/DK2010/050097

§ 371 (c)(1),
(2), (4) Date: Oct. 27, 2011

(87) PCT Pub. No.: WO2010/124694

PCT Pub. Date: Nov. 4, 2010

(65) Prior Publication Data

US 2012/0040804 A1 Feb. 16, 2012

(30) Foreign Application Priority Data

Apr. 30, 2009 (DK) ..... 2009 00562
Jul. 16, 2009 (DK) ..... 2009 00870

(51) Int. Cl.

| | |
|---|---|
| ***A63B 69/20*** | (2006.01) |
| ***A63B 69/28*** | (2006.01) |
| ***A63B 69/34*** | (2006.01) |
| ***A63B 23/14*** | (2006.01) |
| ***A63B 23/16*** | (2006.01) |
| ***A63B 69/00*** | (2006.01) |
| ***A63B 69/24*** | (2006.01) |
| *A63B 21/005* | (2006.01) |
| *A63B 21/06* | (2006.01) |

(52) U.S. Cl.

CPC ..... *A63B 69/0053* (2013.01); *A63B 69/24* (2013.01); *A63B 21/0058* (2013.01); *A63B 21/0608* (2013.01)

USPC ..... 482/83; 482/86; 482/89; 482/44; 482/49

(58) Field of Classification Search

CPC .. A63B 69/004; A63B 69/34; A63B 2208/12; A63B 2210/50; A63B 69/0053; A63B 69/20; A63B 69/201; A63B 69/205; A63B 2069/0006; A63B 21/062; A63B 2220/53; A63B 2225/30; A63B 69/345; A63B 2022/0082

USPC ..... 482/83–90, 1, 44, 49–50, 92–107, 148; 473/438–445; 248/281.11, 631

See application file for complete search history.

(56) References Cited

U.S. PATENT DOCUMENTS 3,601,598 A * 8/1971 Horn ..... 362/418
4,186,922 A 2/1980 Ketchum (Continued)

FOREIGN PATENT DOCUMENTS

WO 2007012830 2/2007

*Primary Examiner* — Oren Ginsberg
*Assistant Examiner* — Andrew S Lo
(74) *Attorney, Agent, or Firm* — Dykema Gossett PLLC

(57) ABSTRACT

The invention concerns an exercise apparatus including a movable implement, the implement consisting of a number of movable parts that are mutually connected with at least one further movable part, where the apparatus is a mobile unit, and where the apparatus further includes a base. The new feature of the apparatus according to the invention is that an implement in the form of at least one set of discs consisting of at least a first and a second movable disc is connected to the base, where the first movable disc in a set of discs is rotatably connected to the base via a first rotary connection, and where the second movable disc in the set of discs is rotatably connected to the first disc. The apparatus may furthermore include more than two movable discs, for example three, four, five or more discs. By joining the individual movable parts in this way, free movement of the individual discs is achieved in this way, the individual discs obviously being dependent on the movements and actions of the other discs. An exercise apparatus with a base and with e.g. three additional discs, where an implement is mounted on the third disc, provides a totally unpredictable and challenging movement pattern.

8 Claims, 7 Drawing Sheets

(56) References Cited

U.S. PATENT DOCUMENTS

| | | | | |
|---|---|---|---|---|
| 5,611,760 | A * | 3/1997 | Jordan | 482/83 |
| 7,770,319 | B2 * | 8/2010 | McDonald | 42/94 |
| 2002/0091042 | A1 * | 7/2002 | Kuo | 482/52 |
| 2004/0159757 | A1 * | 8/2004 | Pfister | 248/284.1 |
| 2004/0224826 | A1 * | 11/2004 | O'Shea | 482/83 |
| 2008/0272256 | A1 * | 11/2008 | Oh | 248/281.11 |
| 2012/0196729 | A1 * | 8/2012 | Rafaeli | 482/110 |

* cited by examiner

EXERCISE APPARATUS

FIELD OF THE INVENTION

The present invention concerns an exercise apparatus including a movable implement, the implement consisting of a number of movable parts that are mutually connected with at least one further movable part, where the apparatus is a mobile unit and where the apparatus further includes a base.

BACKGROUND OF THE INVENTION

There are various types of exercise equipment for hitting or kicking. The best known are punching balls and sandbags. These are typically suspended by a strap or the like, and are mounted on a spring or between two straps with inherent elasticity. Such exercise implements that are partially freely suspended are intended to return to a position in front of the user after he has applied a strike or a kick to the implement. Hereby, a force may be applied the implement again. Such exercise may be very beneficial and may provide qualified sparring to some extent.

However, there is a desire for enabling exercise with a greater degree of challenge, meaning that the prior art implements may tend to be monotonous in their movements. By striking or kicking the prior art types of punching balls and sandbags from different angles, a certain variation in the movement pattern may of course be achieved, but nothing unpredictable happens, and if the user performs approximately the same movement each time, approximately the same movement of the punching ball or the sandbag is achieved as well.

OBJECT OF THE INVENTION

The object of the invention is to indicate a type of exercising implement where action on the exercise implement causes the exercising implement to move in an unpredictable pattern, thus requiring increased concentration as compared with prior art exercising implements such as punching balls and sandbags. Hereby may be achieved an exciting and not the least a demanding form of exercise. This type of exercise is suited to normal exercise as well as for rehabilitation of persons that, e.g., have suffered a thrombus or a brain hemorrhage.

DESCRIPTION OF THE INVENTION

As mentioned in the introduction, the invention concerns an exercise apparatus including a movable implement, where the movable parts are mutually connected with at least one further movable part, where the apparatus is a mobile unit, and where the apparatus further includes a base.

The new feature of the apparatus according to the invention is that an implement in the form of at least one set of discs consisting of at least a first and a second movable disc is connected to the base, where the first movable disc in a set of discs is rotatably connected to the base via a first rotary connection, and where the second movable disc in the set of discs is rotatably connected to the first disc. The apparatus may furthermore include more than two movable discs, for example three, four, five or more discs.

Each disc may advantageously be rotatably connected to an adjacent disc, where each disc is rotatable through 360° about a substantially vertical axis, where the substantially vertical axes of two adjacent discs do not coincide, where the movable connections are arranged on respective discs at points disposed at a given distance from the centres of gravity of the individual discs.

By joining the individual movable discs in this way, free movement of the individual discs is achieved, the individual discs obviously being dependent on the movements and actions of the other discs. In principle, this is a crank mechanism with several movable joints. When these discs are provided with a given and not insignificant weight, an inertia arises in the system, causing the exercise apparatus to perform unpredictable movements, and thus it is possible to challenge the user in different ways. An exercise apparatus with a base and with three additional discs, where an implement is mounted on the third disc, provides a totally unpredictable and challenging movement pattern.

In a particularly preferred variant of an exercise apparatus according to the invention, the exercise apparatus may be provided with one or more handles for operating and using the exercise apparatus. We are thus talking of a handheld version. By such a version, the exercise is not so much acting on the movable discs, but rather the challenge of centering the individual discs so that balance is produced in the exercise apparatus. This requires some concentration, depending on whether the exercise apparatus is arranged or adjusted for an easy or difficult variant. For measuring or monitoring how long a time is used with the apparatus, this may advantageously be provided with an integrated timer, which, e.g., may be a stop watch, a countdown watch, an hourglass or other kind of timer. The applied timers may thus be mechanical or electronic.

A handheld variant of an exercise apparatus according to the invention may weigh from very few grams, being particularly suited for exercising the power of concentration, and up to several kilograms, e.g., five kilograms or even more. The stationary variants mounted on ceiling, wall, floor or table may easily weigh considerably more; however, this is not required with regard to stimulating the power of concentration, but to achieve a fitness enhancing effect, greater weight may be advantageous. For some variants the weight may very well approach one hundred kilograms, or even more.

In a variant of an exercise apparatus according to the invention, instead of movable discs, one or more of the movable parts may be rod-shaped and adapted to rotate relative to the base or to another movable arm about a point close to at least one end of the arm. By having rod-shaped arms there may be achieved an exercise apparatus which is particularly suited for simulating arms or legs of an attacking person. This may, e.g., be used for martial arts training. Such arms on the apparatus may be with lengths up to one meter, or even longer, implying an apparatus with an appreciable radius of action, maybe up to four meters or more. By such an apparatus, several persons may exercise at the same time, as the individual user's action on the apparatus may be blocked and responded to by a another user.

In another variant of an exercise apparatus according to the invention, one or more of the movable parts may be disc-shaped and adapted to rotate in relation to the base or to another movable part about a point close to the periphery of the disc. This model operates in the same way as described above, though only in the way that the movable disc-shaped parts are, e.g., cylindric, edged or with another shape. By, e.g., using cylindric discs with the same diameter, a variant is achieved where it is practically impossible to get, e.g., a finger squeezed between two adjacent movable discs, as the round shape will push the finger away.

In yet another variant of an exercise apparatus according to the invention, the individual movable parts/discs may be with varying weight, thickness and diameter, whereby different challenges are achieved while using the exercise apparatus.

An exercise apparatus including a movable implement according to the invention is typically provided with discs with a fixed centre of gravity and with a given weight, where the weight and the centre of gravity of each individual disc are adapted to the desired movement pattern, but may also be with discs with a displaceable centre of gravity and with a given weight. Thus is achieved a possibility of varying the speed of the exercise apparatus. This is possible as the inertia in the apparatus may be adjusted by moving the centre of gravity in one or more discs on the apparatus. Settings that increase or reduce the degree of difficulty of the exercise may thus be applied.

In a preferred variant of the exercise apparatus according to the invention, the exercise apparatus is driven to move by means of an electric motor, the electric motor acting on the first movable disc in a set of discs. This first disc is forced to rotate at a given speed, in a given direction and for a given time, where speed, direction and period of time may be regulated, e.g., manually or via electronic equipment like a computer or the like. By acting on the exercise apparatus manually by hitting, kicking, by tilting it by one or more hands or in other ways, exercising may be performed, and the advantage of this variant is that the user is challenged by the apparatus by a predetermined variation of degrees of difficulty. Electric motors of different size adapted to the individual exercise apparatus may advantageously be applied. For example, by a very modest table model or in a handheld version, there may be used an electric motor which is powered via a USB plug in a PC or by a built-in battery. Other kinds of drives may obviously be applied according to wish, including, e.g., hydraulic, pneumatic or manual mechanical drives.

A further variant of an exercise apparatus according to the invention may be with an electric motor as well as a generator, where activation of the discs of the exercise apparatus causes the generator to be driven. An exercise apparatus may thus in principle be self-supplying with energy. A user may, for example, actuate the apparatus, thereby generating energy, and when a certain capacity is attained, this energy may be used for giving a still more exciting or demanding exercise/challenge.

An exercise apparatus may be provided with an electric drive and/or with a generator function between two arbitrary discs or movable parts, and may thus entail that the apparatus may be driven in all connections between the discs as well as generate energy for subsequent use, e.g., for operating the exercise apparatus when sufficient strength is not applied for the apparatus to be moved.

In a preferred variant of the invention, a clutch is arranged between the electric motor and the exercise apparatus, preferably a magnetic clutch or a friction clutch. By such a clutch it is possible to actuate the exercise apparatus by a given force in such a way that this force is not entirely absorbed by the electric motor or generator, as the clutch may be provided with a suitably surmountable resistance. However, the resistance in the coupling is preferably to be so great that it is possible to drive the apparatus at least in idling mode.

Another way of adjusting an exercise apparatus including a movable implement according to the invention is by providing the rotatable connections between a base and a disc or between two discs with bearings, where the bearings are provided with adjustable friction.

The movable implement according to the invention may be exchangeable and preferably provided with a resilient cladding, e.g., of rubber with closed or open cells, inflatable or provided with padding. Hereby is achieved the possibility of adapting the implement to the specific type of exercise desired. It may, e.g., be that the exchangeable implement is a movable part corresponding to the rest or a punching ball, a sandbag, a seat or a belt for a person.

An exercise apparatus may be adapted such that the base of the exercise apparatus is arranged above the at least one set of discs, corresponding to an overhead mounting or a mounting suspended from a wall or from a movable and mobile stand. Alternatively, the base of the exercise apparatus may be arranged under the at least one set of discs, corresponding to a floor or table mounting or to a standing mounting on a wall or a stand as mentioned above.

The method of mounting may be a permanent mounting but may also include suction cups, clamping devices and similar devices that make the apparatus movable.

The movable parts corresponding to discs or rods on an exercise apparatus according to the invention may be made of metal, plastic or other suitable material, and may e.g. be solid or contain water, sand or other ballast material so that the wanted inertia can be achieved in the apparatus. The movable parts may be completely or partly filled, something which may influence the movement pattern, e.g., by splashing water.

The implements which can be mounted on an exercise apparatus may, as mentioned above, be exchangeable and be suspended by chains, straps, springs or may be mounted more rigidly on the base.

In a further variant of the invention, one or more implements may be arranged on the movable parts. For example, on the outermost disc may be arranged an implement over as well as under the disc, but implements may be arranged also on the outermost disc as well as on one or more of the other discs, whereby a plurality of different exercising options can be achieved.

When an exercise apparatus according to the invention is not in use, the discs may be brought to a central position and possible be retained in this position by a mechanical locking device connecting the discs. This locking device may also be a magnetic lock which is arranged between respective discs and which exerts such a sufficient force that the discs can be maintained in the desired position, but which is released by a modest application of force.

These magnetic locks may further add an unpredictable element to the movement pattern of the apparatus, as every time the magnetic locking means pass each other they will exert a retarding or accelerating action.

In a variant of the invention, the exercise apparatus may be adapted with magnets with uniform poles such that it is impossible to centre the apparatus, which may be particularly applicable for fitness exercise with a handheld exercise apparatus. Such a variant may of course also find application in connection with a more stationary variant of an exercise apparatus according to the invention.

An exercise apparatus according to the invention may be used for various types of exercise, e.g., fitness exercises, rehabilitation, concentration exercises, reaction training, reflex training, as toys for children and adults, and so on. The abundant application options will readily appear to the skilled in the art.

In order to analyse an exercise process, an exercise apparatus according to the invention may be provided with built-in sensors for measuring impact energy, the number of actions, or the like. Such data may suitably be transferred to a PC where data may be processed and stored.

An exercise apparatus according to the invention may be used, among others, in the office, at home, in fitness centres, in boxing premises, and so on. It may also be used in the form of a sports game in, e.g., a game arcade or at home. Such an apparatus may be programmed to various options, e.g., the number of persons in the game, and the apparatus may possibly be coupled to a video game console where graphic images form part of the exercise.

By all variants of an exercise apparatus according to the invention, the apparatus may be adapted for mounting and dismounting movable parts, something which may be provided by an easy-operated click system or similar.

Alternatively, the apparatus may be adapted such that a locking device may connect one or more discs such that these appear as one movable part, or as one or more parts fixed to the base of the apparatus such that the apparatus appear with fewer parts. The possibility of regulating the degree of difficulty is hereby achieved in an additional way. Such a locking device may, e.g., be one or more displaceable pins which by actuation are brought to engage corresponding cutouts, thereby locking one or more movable parts to each other.

By an exercise apparatus according to the invention, training of concentration, coordination and physical fitness may be achieved. As mentioned, there may be table models, floor models, handheld models or floor models that may be moved according to need. There may also be provided models that are operated by foot, where the exercise apparatus is disposed on the floor and where a user puts his foot on the uppermost movable part, thus attempting to get respective movable parts in balance. Concentration, coordination and so one are hereby trained, but, e.g., also a knee, an ankle or other joints in a leg.

DESCRIPTION OF THE DRAWING

The invention is described in the following with reference to the drawing, wherein.

DETAILED DESCRIPTION OF EMBODIMENTS OF THE INVENTION

Figure 1:
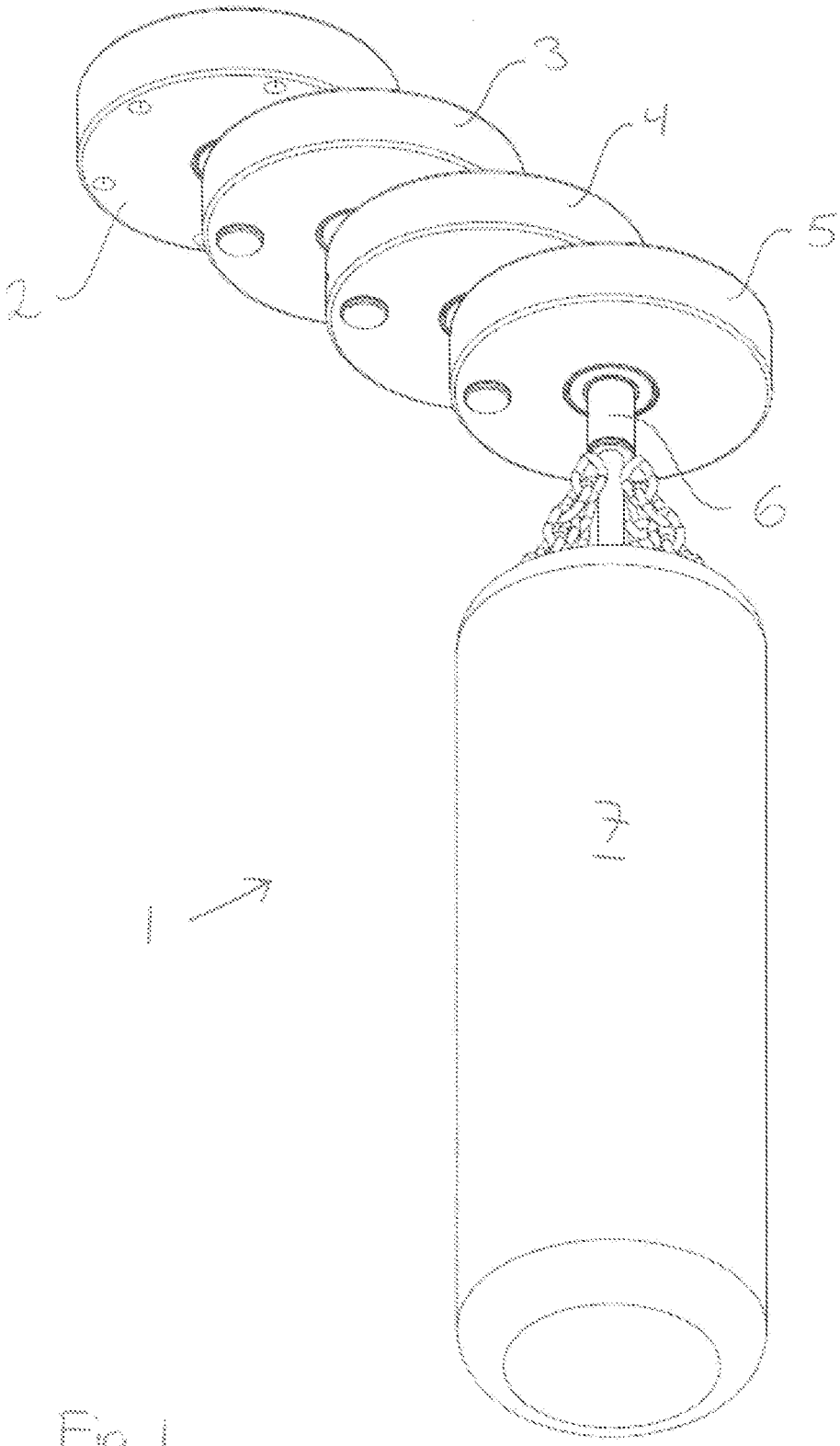
FIG. 1 shows an exercise apparatus intended for overhead suspension, with disc-shaped movable parts and equipped with a sandbag.

In FIG. 1 is seen an exercise apparatus 1 adapted for overhead mounting. The exercise apparatus 1 is provided with a base 2 and three disc-shaped movable parts 3, 4, 5, and on the outermost part 5 there is a fixing unit 6 upon which a implement 7 is mounted in the form of a sandbag. The base 2 is intended for being secured on a fitting or directly to a ceiling (not shown). Between the base 2 and the movable part 3, between the other parts 3 and 4 and between 4 and 5 there is a centre of rotation where the discs 3, 4, 5 may freely rotate about a vertical axis. In principle, this is a mechanism corresponding to a crank, but with several movable joints 3, 4, 5. The movable parts 3, 4, 5 may advantageously have a weight of more than ten kilograms, in some variants up to twenty kilograms or more. The weight of the movable parts 3, 4, 5 has great influence on the inertia of the exercise apparatus and is thus an important factor for the pattern of movement of the apparatus 1.

Figure 2:
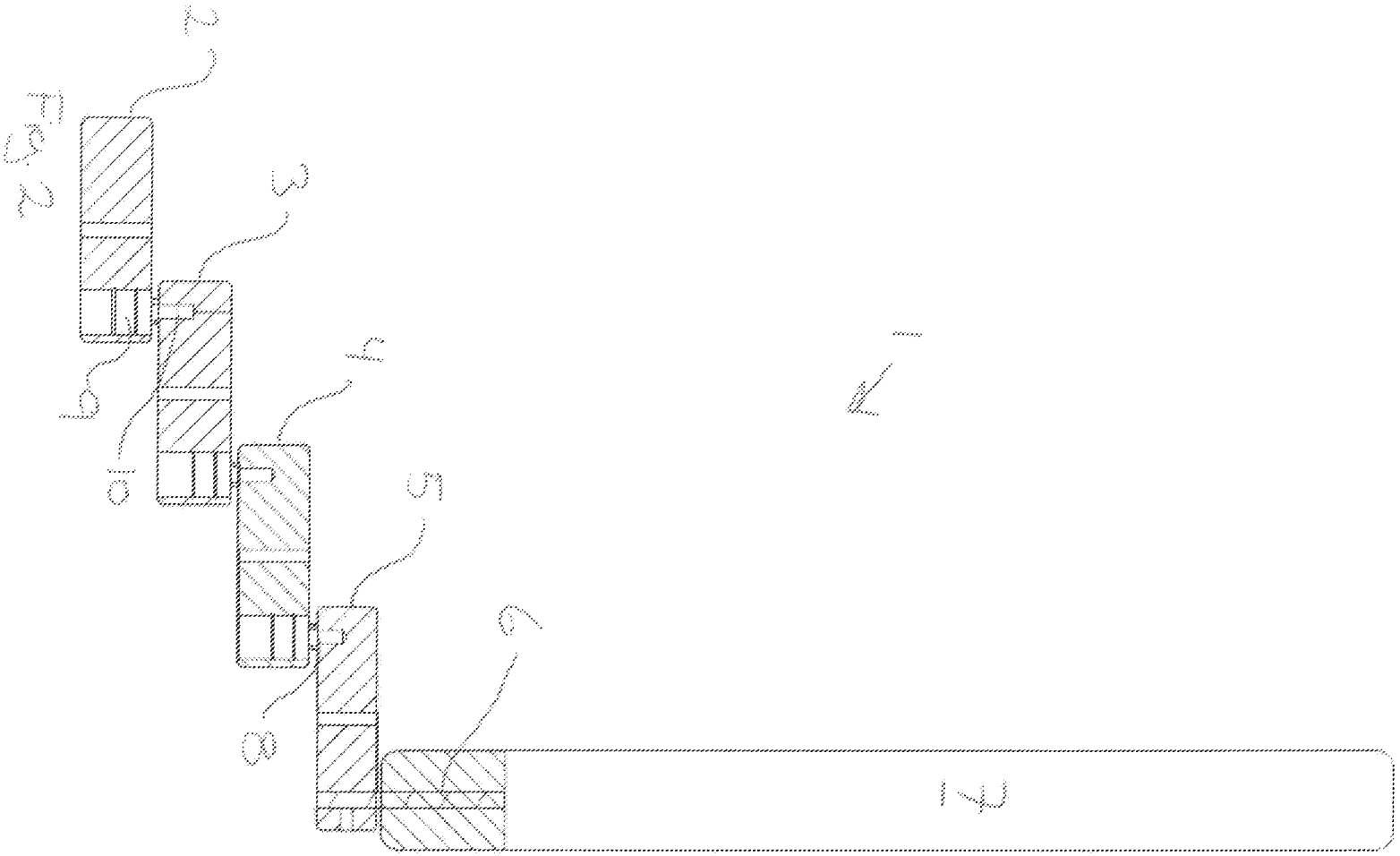
FIG. 2 shows a standing exercise apparatus in cross-section.

FIG. 2 shows a standing exercise apparatus 1 where the base 2 and the movable parts 3, 4, 5 are shown in cross-section. Between the individual parts 2, 3, 4, 5 a rotary joint 8 is seen which in the shown variant is provided with a ball bearing 9 in the lower part and with a journal 10 in the upper part. On the outermost disc 5 is seen a fixing unit 6 and an implement 7 which is shown here as a slender, rod-shaped element. Upon this implement 7, other implements may possibly be mounted, but these other implements may also replace the shown implement 7.

Figure 3:
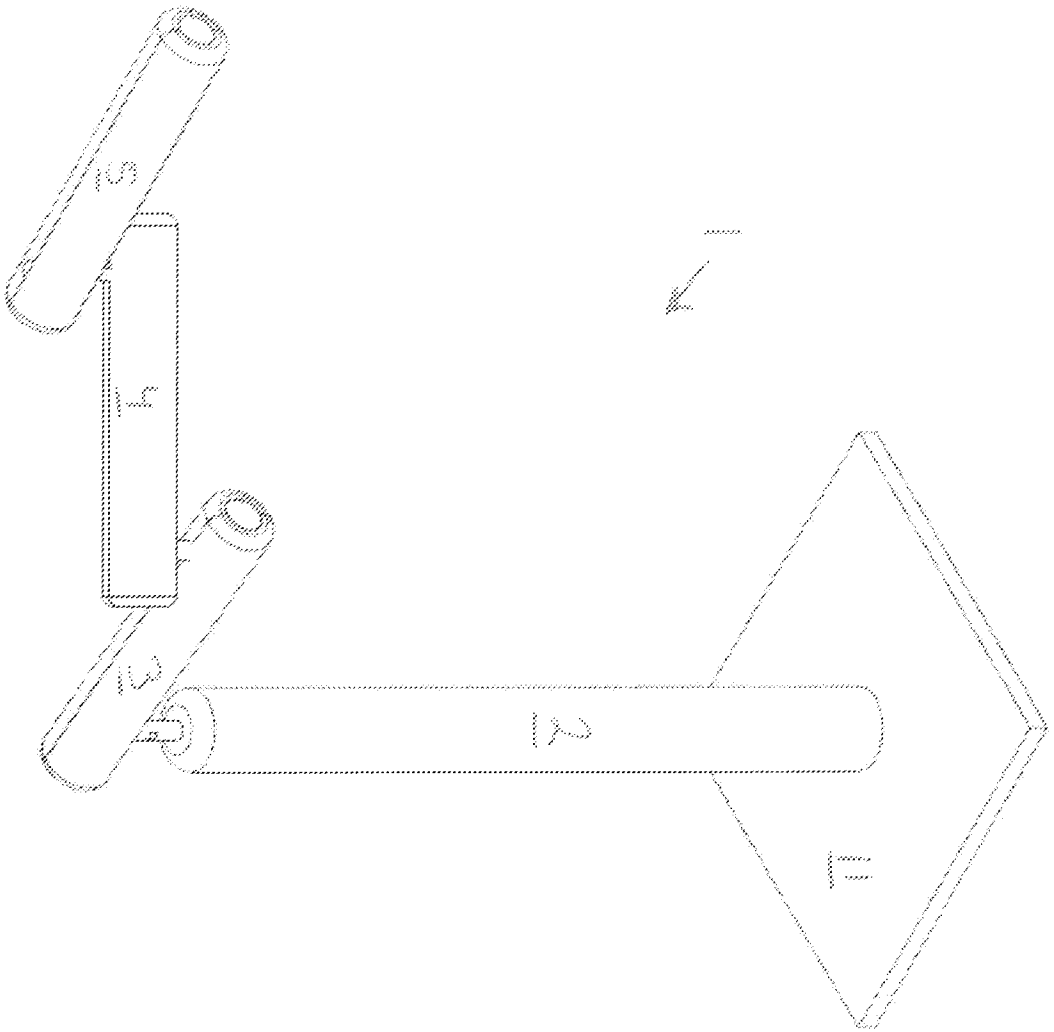
FIG. 3 shows an exercise apparatus with rod-shaped movable parts.

FIG. 3 shows an exercise apparatus 1 which is adapted for overhead mounting by a plate member 11. From this plate member 11, a base 2 extends downwards. At the end of the base 2, a rod-shaped arm 3 is mounted. This rod-shaped arm 3 is further connected to a corresponding arm 4 which is also connected to an arm 5. In this variant, it is the arm 5 itself that constitutes the implement, as this is to symbolise an attacker's arm or leg while striking or kicking. In the shown variant, the movable parts 3, 4, 5 are covered by a resilient surface which, e.g., may be of cell rubber of suitable kind. In this variant of an exercise apparatus, the arms 3, 4, 5 are rotatably interconnected, like in the other variants, and may therefore be moved in an unpredictable pattern when the first 3, second 4 or third 5 movable part, respectively, is actuated.

Figure 4:
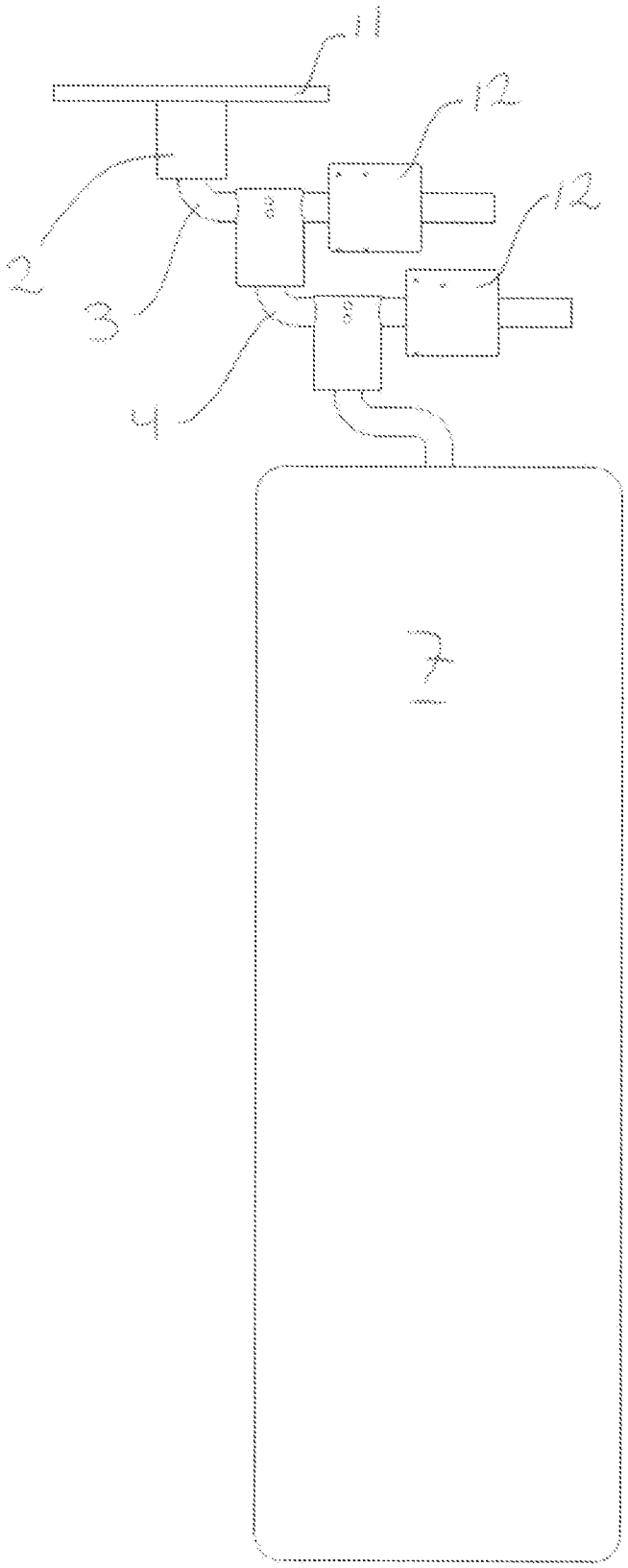
FIG. 4 shows an exercise apparatus with adjustable centre of gravity in the movable parts.

In FIG. 4 is seen yet another variant of an exercise apparatus where the apparatus is shown with adjustable centre of gravity in the movable parts 3, 4. The shown variant of the apparatus 1 is provided with a fitting 11 intended for mounting in a ceiling and further including a base 2, two movable parts 3, 4 and an implement 7. A displaceable and possibly replaceable weight 12 is provided on respective parts 3, 4. The weights 12 may be fixed by means (not shown) at a given position, and the centre of gravity and thereby the movement characteristic of the exercise apparatus 1 may thereby be changed.

Figure 5:
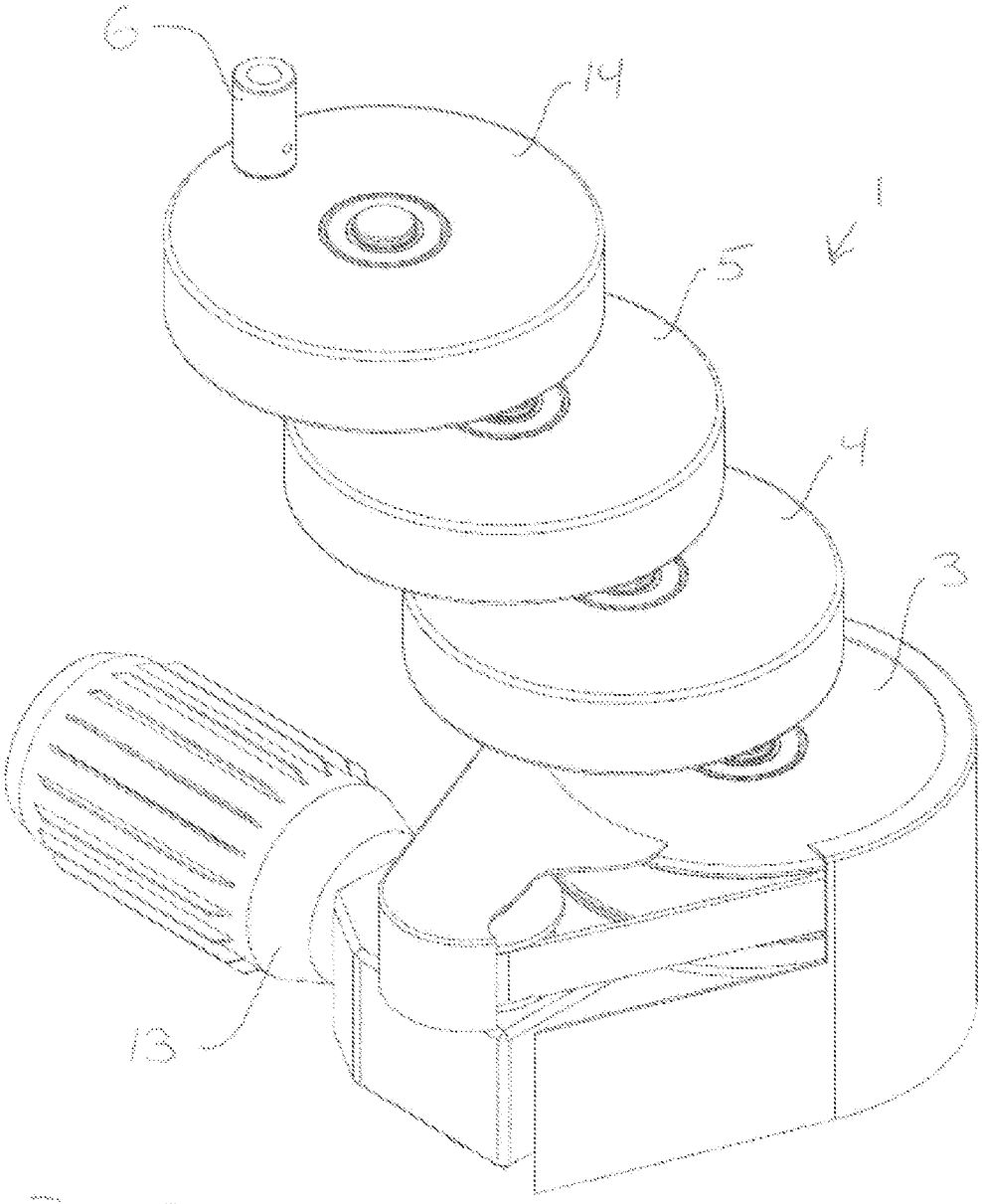
FIG. 5 shows an exercise apparatus with an electric motor.

In FIG. 5 appears an exercise apparatus 1 with an electric motor 13 with gear constituting the base 2. The electric motor 13 drives the innermost movable disc 3 for rotation at a given speed and direction. Hereby, the entire apparatus 1 is activated, and the discs 4, 5 and 14 are actuated to move. When a user actuates an implement 7, this will "disturb" the driven movement, and unpredictable movements of respective discs 4, 5, 14 and the implement 7 will result. By mounting a clutch (not shown), e.g., a magnetic clutch, between the electric motor 13 and the innermost disc 3, actions on the implement 7 may be of a magnitude allowing movements of the disc 3 against the direction of rotation of the electric motor.

Figure 6:
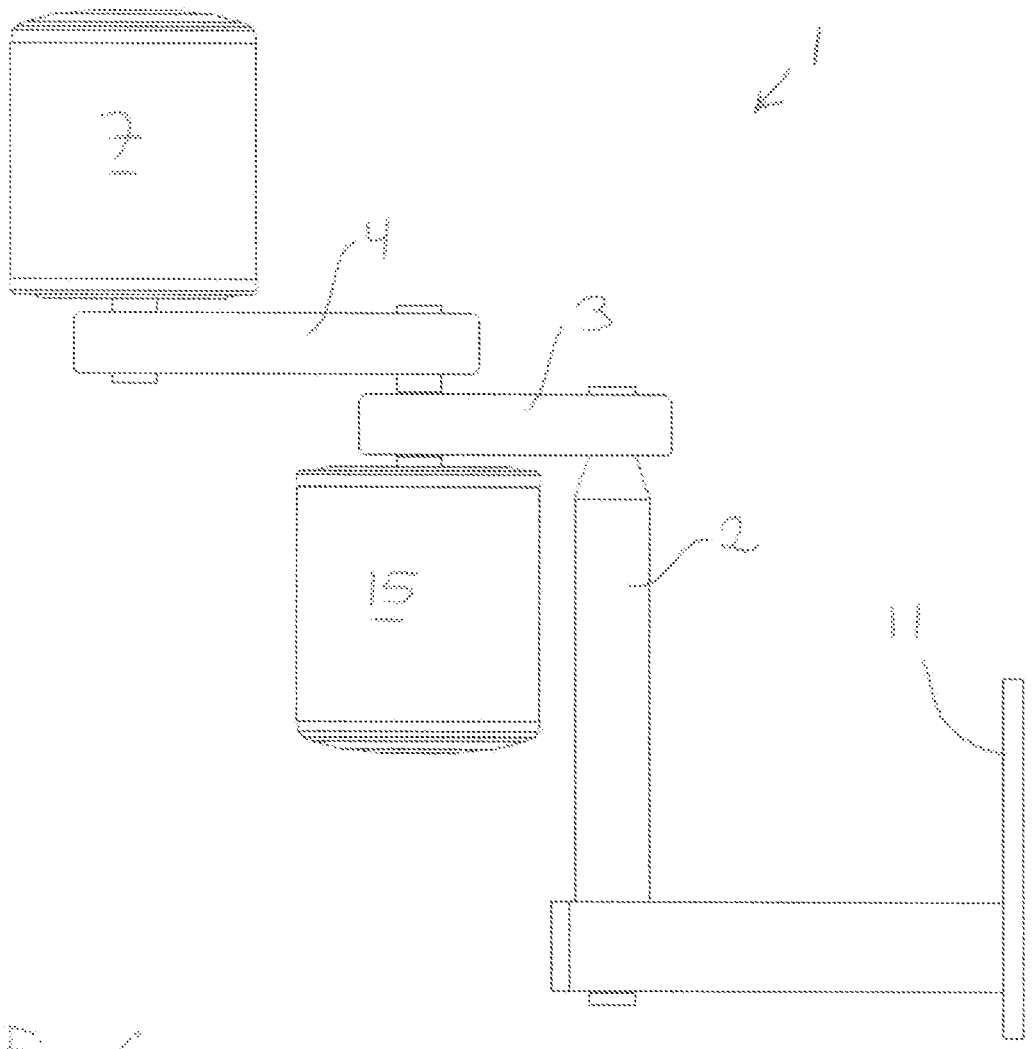
FIG. 6 shows an exercise apparatus with two discs and with two implements.

FIG. 6 shows an exercise apparatus 1 in a version with a base 2, two movable parts 3 and 4 and with two implements 7 and 15. The innermost implement 15 may, together with the part 3, rotate about the base 2 while the other implement 7 may rotate about the first implement 15 and the base 2. This variant of the exercise apparatus 1 allows for actuating the apparatus 1 on both implements 7 and 15, possibly adding extra challenge to the exercise.

Figure 7:
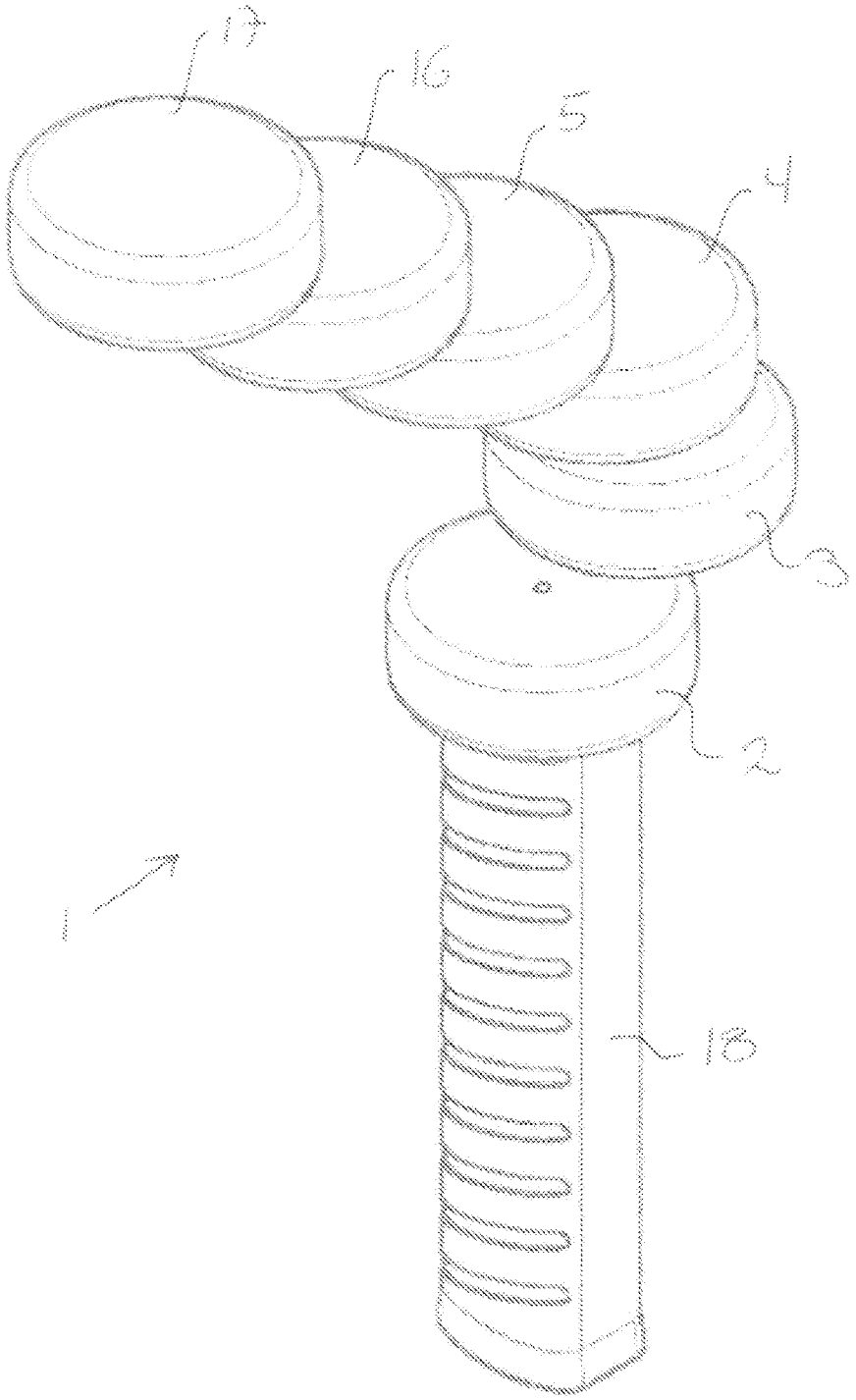
FIG. 7 shows a handheld exercise apparatus with five disc-shaped movable parts.

In FIG. 7 appears an exercise apparatus 1 which is adapted as a handheld version where the exercise apparatus 1 is provided with a disc-shaped base 2 and five disc-shaped movable parts 3, 4, 5, 16, 17. The base 2 is fixed to a handle 18 which in the shown variant is long enough to provide space for both hands of the user. Between the base 2 and the arm 3, and between the other arms 3, 4, 5, 16, 17, there is a centre of rotation where the arms may freely rotate about a vertical axis, e.g., in the same way as by the variant shown in FIG. 1. In the handheld version the total weight is typically not very high, corresponding to, e.g., 0.5 to 2 kilograms. Also in this variant, the weight of the individual discs may differ, and the diameters may be different as well, influencing the inertia and movement pattern of the exercise apparatus.

The invention is not limited to the variants discussed and mentioned above or as shown in the Figures, but may be supplemented and adapted in any thinkable way within the scope of the invention which is defined in the subsequent patent claims.

The invention claimed is:

1. An exercise apparatus which comprises:

a base, a set of discs comprising a first disc which has a center of gravity, and a second disc which has a center of gravity, a first rotary connection means connecting said first disc to said base and enabling 360 ° rotation of said first disc about a first axis, a second rotary connection means connecting said second disc to said first disc and enabling 360 ° rotation of said second disc about a second axis, said second axis being parallel to but offset relative to said first axis, and an implement connected to at least one disc of said set of discs for gripping by a user during a workout.

2. The exercise apparatus according to claim 1, wherein said set of discs includes a third disc, and including a third rotary connection means connecting said third disc to said second disc and enabling 360 ° rotation of said third disc about a third axis parallel to but offset from said first and second axes.

3. There exercise apparatus according to claim 2, including a handle connected to said base.

4. The exercise apparatus according to claim 2, including a fixing unit attached to said third disc.

5. The exercise apparatus according to claim 2, wherein each of said first, second and third rotary connection means comprises journals and bearings.

6. The exercise apparatus is according to claim 2, wherein said implement is connected to said third disc and comprises a rod-shaped element.

7. An exercise apparatus which comprises:

a base, a set of discs comprising a first disc which has a center of gravity, a second disc which has a center of gravity, a third disc which has a center of gravity, and a fourth disc which has a center of gravity, a first rotary connection means connecting said first disc to said base and enabling 360 ° rotation of said first disc about a first axis, a second rotary connection means connecting said second disc to said first disc and enabling 360 ° rotation of said second disc about a second axis, said second axis being parallel to but offset relative to said first axis, a third rotary connection means connecting said third disc to said second disc, a fourth rotary connection means connecting said fourth disc to said third disc, and an electric motor for rotating said fourth disc.

8. An exercise apparatus which comprises:

a base, a set of discs comprising a first disc which has a center of gravity, a second disc which has a center of gravity, and a third disc which has a center of gravity, a first rotary connection means connecting said first disc to said base and enabling 360° rotation of said first disc about a first axis, a second rotary connection means connecting said second disc to said first disc and enabling 360° rotation of said second disc about a second axis, said second axis being parallel to but offset relative to said first axis, a third rotary connection means connecting said third disc to said second disc and enabling 360° rotation of said third disc about a third axis, said third axis being parallel to but offset relative to said first and second axes, and an implement connected to said third disc, said implement comprising a sandbag.

* * * * *